US006748599B1

(12) United States Patent
Farady et al.

(10) Patent No.: US 6,748,599 B1
(45) Date of Patent: Jun. 15, 2004

(54) HAND COVERING DEVICE FOR DRIVERS

(76) Inventors: Michael Farady, 3709 Hidden Hollow, Austin, TX (US) 78731; Katherine K. Farady, 3709 Hidden Hollow, Austin, TX (US) 78731

( * ) Notice: Subject to any disclaimer, the term of this patent is extended or adjusted under 35 U.S.C. 154(b) by 0 days.

(21) Appl. No.: 10/170,073

(22) Filed: Jun. 11, 2002

(51) Int. Cl.[7] ..... A41D 13/08
(52) U.S. Cl. ..... 2/16
(58) Field of Search ..... 2/16, 20, 159, 2/160, 162, 163, 170, 161.6; 602/21

(56) References Cited

U.S. PATENT DOCUMENTS

| | | | | | |
|---|---|---|---|---|---|
| 2,205,957 | A | * | 6/1940 | Kinkis | 2/20 |
| 2,394,136 | A | * | 2/1946 | Bakke | 2/16 |
| 2,683,878 | A | * | 7/1954 | Davilla | 2/16 |
| 3,490,768 | A | * | 1/1970 | Archer | 473/213 |
| 3,908,197 | A | * | 9/1975 | Griffin | 2/20 |
| 4,785,478 | A | | 11/1988 | Mosley | 2/161 R |
| 4,809,366 | A | | 3/1989 | Pratt | 2/170 |
| 4,967,775 | A | * | 11/1990 | Kaiser | 132/73 |
| 5,125,115 | A | | 6/1992 | Lincoln | 2/159 |
| 5,628,062 | A | | 5/1997 | Tseng | 2/16 |
| 5,911,309 | A | * | 6/1999 | Penney | 2/16 |

OTHER PUBLICATIONS

Kathryn Hatch, Textile Science, 1993 by West Publishing, pp. 46–47.*

* cited by examiner

*Primary Examiner*—Katherine Moran
(74) *Attorney, Agent, or Firm*—Sturm & Fix LLP

(57) ABSTRACT

A covering device (10) for the back of a user's hand (100) while driving; wherein, the device includes a cover member (20) that may be fabricated from a double thickness of stiff material (21) or a plastic insert (22) surrounded by a soft fabric envelope (23) and a wrist engaging member (30) that may include an elongated strap element (32) having cooperating fasteners (33) or a bracelet element (34) wherein the wrist engaging member (30) is hingedly connected to the cover member (20) to create a free end and a captive end on the cover member (20).

7 Claims, 1 Drawing Sheet

HAND COVERING DEVICE FOR DRIVERS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of specialized covering devices in general and in particular to a specialized cover that protects the back of a driver's left hand from the effects of sunburn while driving with an open window.

2. Description of Related Art

As can be seen by reference to the following U.S. Pat. Nos. 4,809,366; 4,785,478; 5,125,115; and, 5,628,062, the prior art is replete with myriad and diverse covering devices used to prevent the back of a vehicle operator's hand from becoming sunburned.

While all of the aforementioned prior art constructions are more than adequate for the basic purpose and function for which they have been specifically designed, they are uniformly deficient with respect to their failure to provide a simple, efficient, and practical hand covering device that is lightweight in construction and imposes no restrictions on the user's fingers.

All of the aforementioned prior art constructions envelop or surround at least some of the user's fingers and this fact requires an undue amount of manual manipulation in either the attachment or disengagement of the device relative to the user's hand and/or causes chafing of the skin surrounding the fingers thereby reducing the probability that the device will be worn on a regular basis.

As a consequence of the foregoing situation, there has existed a longstanding need among vehicle operators for a new and improved hand covering device that is only secured to the user's wrist and has an inherent stiffness that maintains the device in the proper relationship relative to the back of the user's hand; and, the provision of such an arrangement is the stated objective of the present invention.

BRIEF SUMMARY OF THE INVENTION

Briefly stated, the hand covering device for vehicle operators that forms the basis of the present invention comprises in general a cover unit and a securing unit wherein the cover unit is provided with an inherent stiffness that will maintain the cover unit in a "finger free" covering position relative to the back of a user's hand when the securing unit is engaged with the user's wrist.

As will be explained in greater detail further on in the specification, the cover unit comprises a semi-eliptical shaped cover member having a generally arcuate cross-sectional configuration that follows the contour of a driver's hand while grasping a steering wheel; wherein, the cover member is fabricated similar to the bill of a ball cap and may include either a soft fabric covering over a plastic insert or a double thickness relatively stiff fabric.

In addition, the securing unit comprises a wrist engaging member in either strap or bracelet form wherein the wrist engaging member is hingedly attached to the cover member to allow the necessary flexibility to the device so that the device will not chafe the user's skin.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
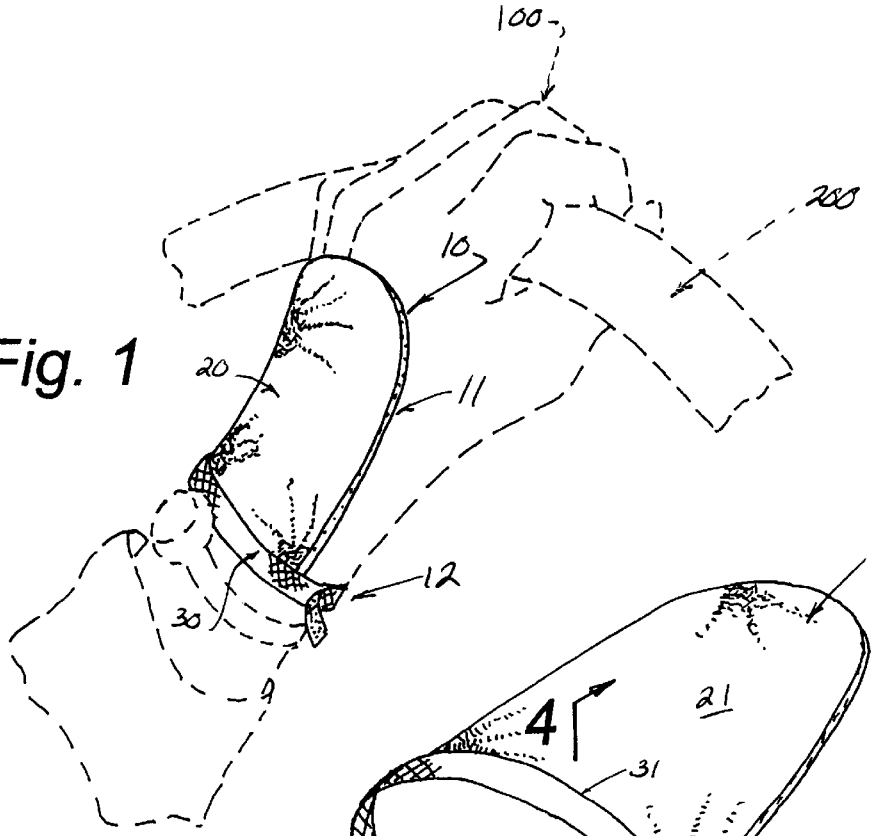
FIG. 1 is a perspective view of the hand covering device installed on a user's hand.

As can be seen by reference to the drawings, and in particularly to FIG. 1, the hand covering device that forms the basis of the present invention is designated generally by the reference number 10. The device 10 comprises in general a cover unit 11 and a securing unit 12. These units will now be described in seriatim fashion.

Figure 2:
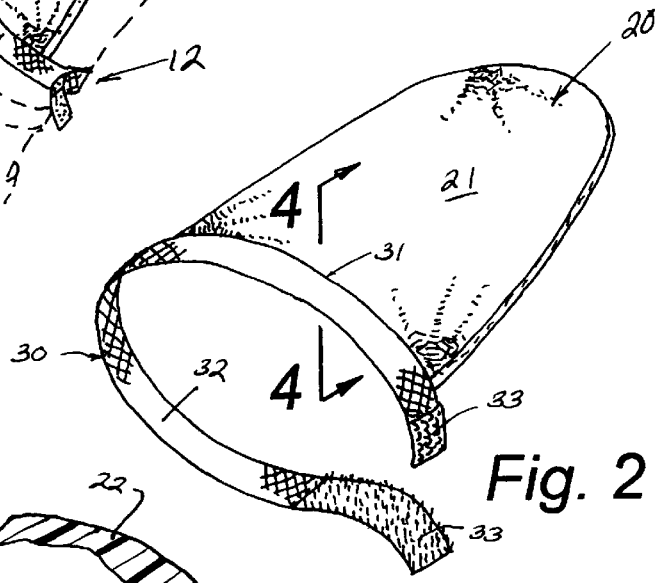
FIG. 2 is an isolated perspective view of the hand covering device.
Figure 3:
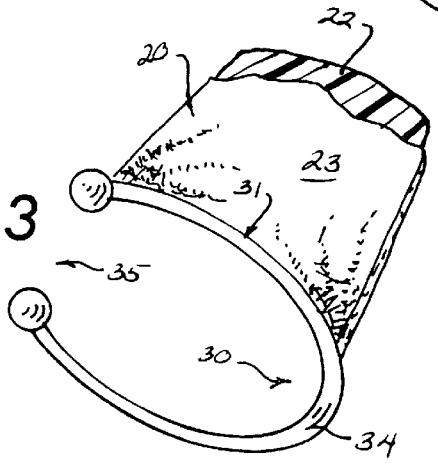
FIG. 3 is a partial cut away view of one version of the device.
Figure 4:
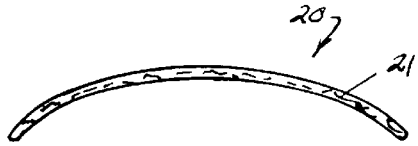
FIG. 4 is a cross-sectional view of the device taken through line 4—4 of FIG. 2.

As shown in FIGS. 2 through 4, the cover unit 11 comprises a semi-eliptical shaped cover member 20 having an arcuate cross-sectional configuration as shown in FIG. 4 that is designed and intended to conform to the back of a user's hand 100 at or below the user's knuckles while gripping a steering wheel 200 as depicted in FIG. 1.

In addition, as shown in FIGS. 2 and 4, the cover member 20 of this invention may comprise either a double thickness of generally stiff material 21 such as is found in conventional ball caps; or in the alternative, a contoured plastic insert 23 may be enveloped in a soft fabric envelope 23 as depicted in FIG. 3.

Furthermore, the securing unit 12 as shown in FIGS. 1 through 3, comprises in general a wrist engaging member 30 that is hingedly connected as at 31 to the cover member 20 to create a free end and a captive end on the cover member 20 wherein in one version of the preferred embodiment, the wrist engaging member 30 comprises an elongated strap element having cooperating hook and loop fasteners 33 33'; and, in the other version of the preferred embodiment, the wrist engaging member 30 comprises a flexible bracelet element 34 having an expansible opening 35 adapted to receive the user's wrist in a well recognized manner to position the cover member 20 over the back of the user's hand 100.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A covering device for covering a limited portion of a driver's hand to protect that limited portion from sunburn wherein, the device comprises:

a cover unit including an opaque cover member that is dimensioned to only cover a limited portion of the back of a user's hand wherein, the limited portion extends from the user's wrist to a location spaced from the user's fingers wherein, the cover member is provided with a semi-eliptical configuration, as well as, an arcuate cross-sectional configuration; wherein, the cover member comprises a plastic insert surrounded by a fabric envelope and, a securing unit comprising a wrist engaging member connected to the cover member such that the cover member has a free end and a captive end.

2. The device as in claim 1; wherein, the cover member extends from the user's wrist to a location proximate the user's knuckles.

3. The device as in claim 1; wherein, the wrist engaging member comprises an elongated strap element having opposite ends provided with cooperating fasteners.

4. The device as in claim 1; wherein, the wrist engaging member comprises a bracelet element.

5. The device as in claim 1; wherein, the wrist engaging member is hingedly secured to the cover member.

6. The device as in claim 3; wherein, the wrist engaging member is hingedly secured to the cover member.

7. The device as in claim 4; wherein, the wrist engaging member is hingedly secured to the cover member.

* * * * *